US011477578B1

(12) United States Patent
Garcia

(10) Patent No.: US 11,477,578 B1
(45) Date of Patent: Oct. 18, 2022

(54) SPEAKER BASKET WITH SPLASH SHIELD

(71) Applicant: Harman International Industries, Incorporated, Stamford, CT (US)

(72) Inventor: Mario Garcia, Corregidora (MX)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 17/379,831

(22) Filed: Jul. 19, 2021

(51) Int. Cl.
*H04R 9/06* (2006.01)
*H04R 1/02* (2006.01)

(52) U.S. Cl.
CPC ..... *H04R 9/06* (2013.01); *H04R 1/02* (2013.01)

(58) Field of Classification Search
CPC . H04R 9/045; H04R 1/02; H04R 9/06; H04R 9/043; H04R 7/16; H04R 25/60; H04R 1/026; H04R 1/18; H04R 1/1075; H04R 1/2892; H04R 1/025; H04R 7/20; H04R 7/22; H04R 9/04; H04R 9/046; H04R 2201/025; H04R 2307/021; H04R 2499/13; H04R 2201/021; H04R 31/006; H04R 1/06; H04R 1/20; H04R 1/00; H04R 1/24; H04R 25/00; H04R 7/18; H04R 499/13; B60R 2011/0066; B60R 11/0223; B60R 11/0217; B60R 2011/0024; B60R 2011/0043; B60R 2011/0021
USPC ..... 381/386, 86, 395, 389, 361, 391; 181/141, 199, 148, 189, 175, 190, 198
See application file for complete search history.

(56) References Cited

U.S. PATENT DOCUMENTS

2004/0247150 A1* 12/2004 Iwaya ..... H04R 1/025 381/389
2007/0098204 A1* 5/2007 Iekura ..... B60R 11/0223 381/387
2007/0165901 A1* 7/2007 Hayasaka ..... H04R 31/006 381/386

* cited by examiner

*Primary Examiner* — Alexander Krzystan
*Assistant Examiner* — Julie X Dang
(74) *Attorney, Agent, or Firm* — Angela M. Brunetti

(57) ABSTRACT

A polycarbonate speaker basket with a plurality of slots positioned circumferentially about an opening on a perimeter of a rear surface and a polypropylene splash shield that attaches to the rear surface of the speaker basket. The splash shield has a perimeter wall having a predetermined height. A plurality of tabs on a first surface of the perimeter wall aligns with and are inserted into the plurality of slots, and a plurality of guards extend across the opening of the splash shield.

10 Claims, 8 Drawing Sheets

SPEAKER BASKET WITH SPLASH SHIELD

TECHNICAL FIELD

The present disclosure relates to a speaker assembly for automotive use, and more particularly to a speaker basket and splash shield for the speaker assembly.

BACKGROUND

Audio systems in vehicles often include speakers mounted in the vehicle doors. Generally, in a vehicle application, it is desirable for the speakers to be lightweight, compact, and durable. However, when the speaker is mounted in the vehicle door, vibrations from the vehicle are a concern. Another concern is that the speaker is typically assembled in the door below the window, which may expose the speaker to water, such as from weather or a car wash, causing damage to the speaker components adversely affecting its performance.

For speakers assembled in vehicle doors, it is typical to use a plastic speaker basket into which a loudspeaker is glued in place. However, it is common for the glue to fail. This may happen, for example, during assembly or due to vibrations from the vehicle driving on a road surface, where the weight of the motor causes the loudspeaker to detach from the glue holding it in the speaker basket. As a result, the speaker may rattle or vibrate which adversely affects the speaker performance.

Protecting the speaker from water is commonly accomplished with a waterproof seal or boot that encloses the speaker. However, enclosing the speaker adversely affects its performance because the cover reduces a Sound Pressure Level (SPL) of the speaker output.

SUMMARY

A speaker assembly including a speaker, a speaker basket having a plurality of slots positioned circumferentially about an opening on a perimeter of the basket. A splash shield has a perimeter wall having a predetermined height, a plurality of tabs on a first surface of the perimeter wall aligns with and are inserted into the plurality of slots, and a plurality of guards extend across the opening of the splash shield.

In one or more embodiments the speaker basket is molded from polycarbonate and the splash shield is molded from thermoplastic.

In one or more embodiments one slot in the plurality of slots is a locking slot and one tab on the splash shield, that aligns with the locking slot, has an extension for locking the tab into the locking slot.

In one or more embodiments, the splash shield has a living hinge molded into the perimeter wall. The living hinge folds over the wire harness connector to protect the connector.

Elements and steps in the figures are illustrated for simplicity and clarity and have not necessarily been rendered according to any sequence. For example, steps that may be performed concurrently or in different order are illustrated in the figures to help to improve understanding of embodiments of the present disclosure.

DETAILED DESCRIPTION

While various aspects of the present disclosure are described with reference to a speaker basket and splash shield as shown in FIGS. 1-8, the present disclosure is not limited to such embodiments, and additional modifications, applications, and embodiments may be implemented without departing from the present disclosure. In the figures, like reference numbers will be used to illustrate the same components. Those skilled in the art will recognize that the various components set forth herein may be altered without varying from the scope of the present disclosure.

Figure 1:
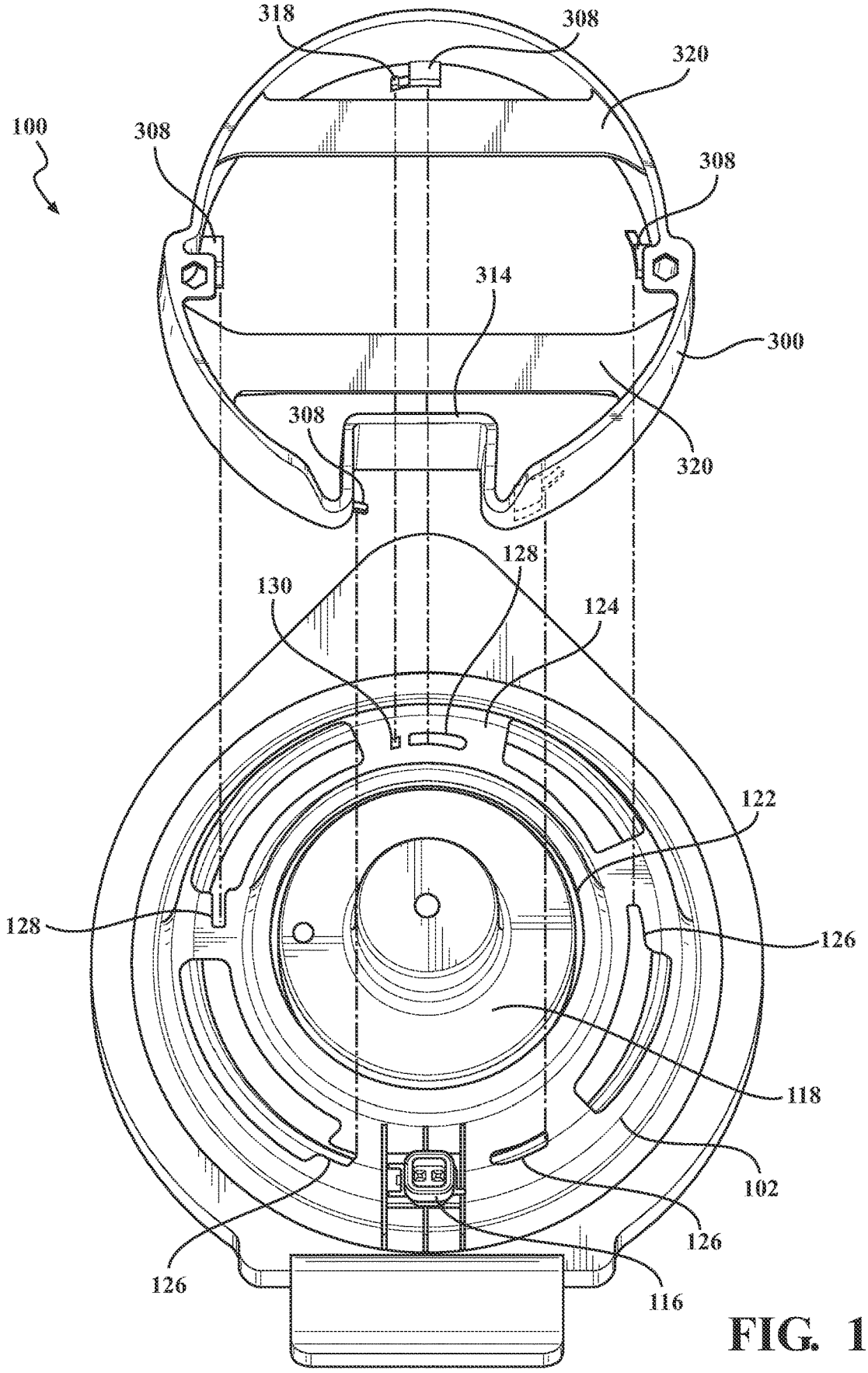
FIG. 1. is an exploded view of a speaker assembly with a basket and splash shield according to one or more embodiments.

FIG. 1 is an exploded view of a speaker assembly 100 that is mounted into a door frame of an automotive vehicle (not shown). A basket 102 contains all the components of a speaker driver, including but not limited to a frame, a cone, terminals, a voice coil, and a connector 116 for a wire harness (not shown). The basket 102 is molded in one piece with an opening 122 for receiving a shell pot 118. The shell pot 118 is made of a rigid material such as metal and receives a speaker motor, that includes (but is not shown in FIG. 1), a back plate or center pole, a permanent magnet, and a front or top plate. A splash shield 300 attaches to a rear surface 124 of the basket 102 as shown in FIG. 2.

Figure 2:
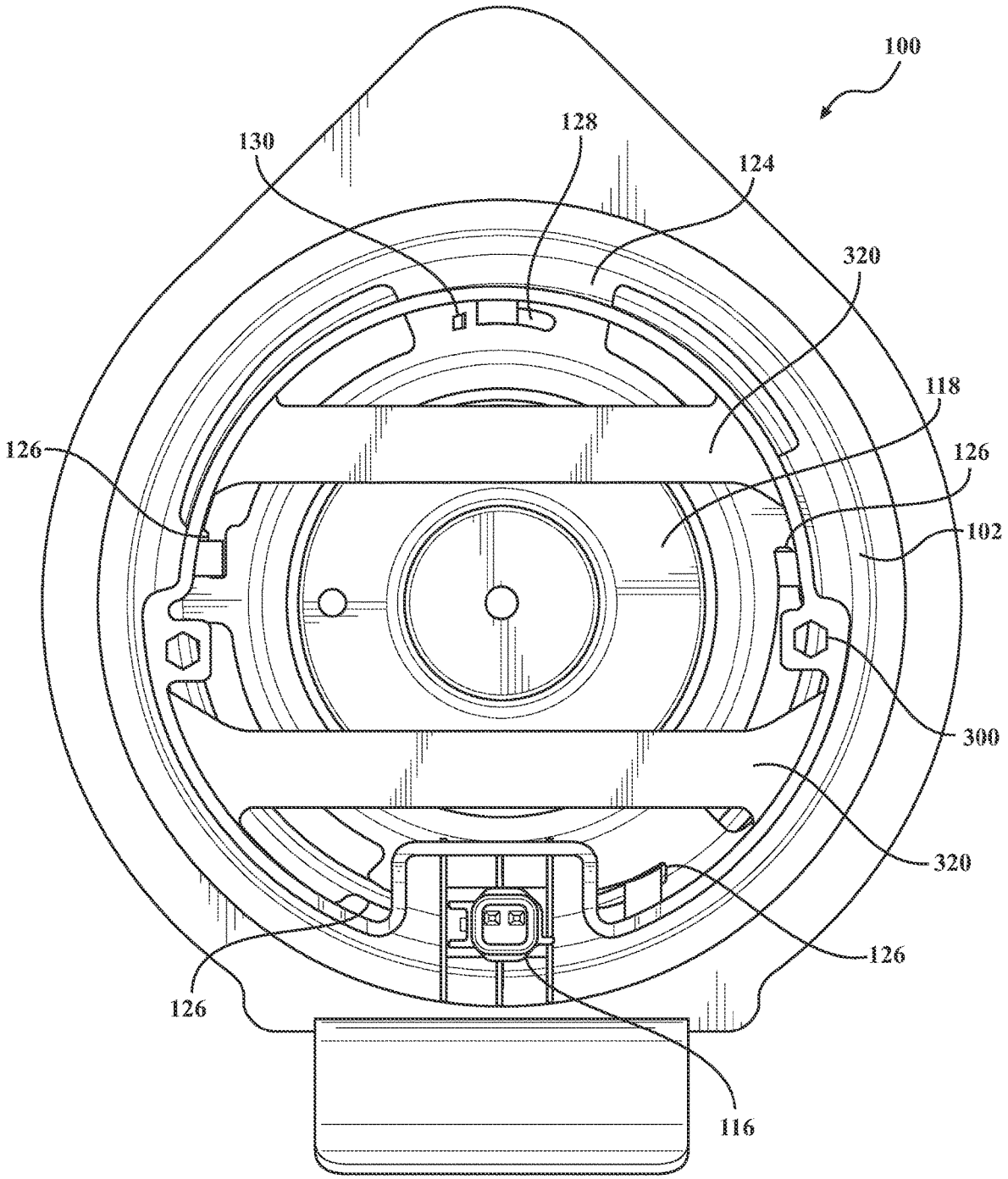
FIG. 2 is a rear view of the speaker assembly according to one or more embodiments.

FIG. 2 is a rear view of the speaker assembly 100. The rear surface 124 of the basket 102 has a plurality of slots 126 spaced a distance from each other circumferentially around the opening 122 of the basket 102. The rear surface 124 of the basket 102 has an opening 130 adjacent at least one of the slots 128 in the plurality of slots 126. The opening 130 at the at least one slot 128 receives a tab portion (to be described later herein) of the splash shield 300 and locks the position of the splash shield relative to the rear surface 124 of the basket 102. The basket 102 is formed of a rigid plastic material, for example, polycarbonate material.

Figure 3:
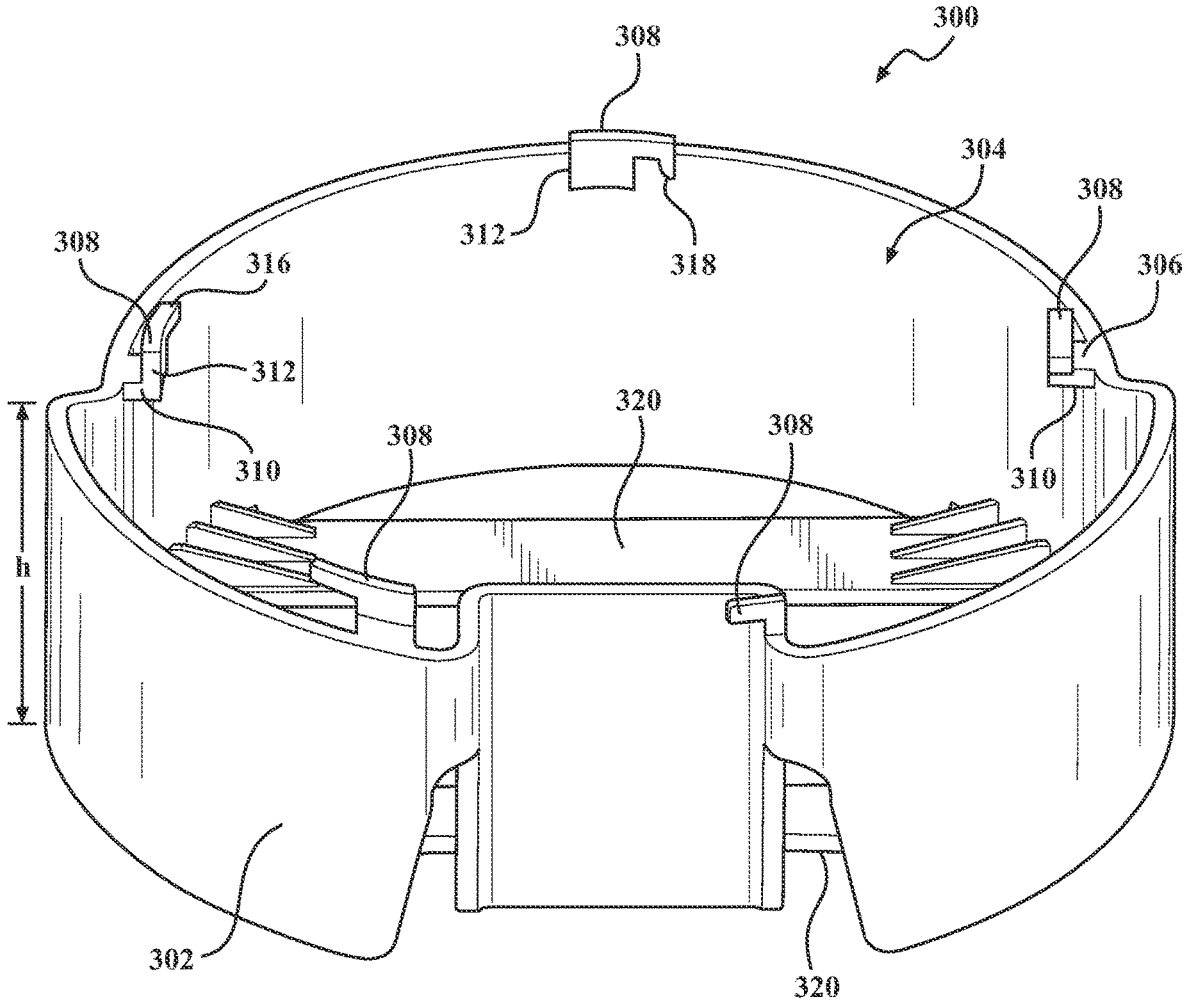
FIG. 3 is a perspective view of a splash shield according to one or more embodiments.

FIG. 3 is a perspective view of the splash shield 300 that is molded as one piece from a less rigid thermoplastic material, for example, polypropylene. The splash shield 300 has a perimeter wall 302 and an opening 304 that generally coincides with the opening 122 of the basket 102. The splash shield 300 has a first surface 306 that faces, and attaches to, the rear surface 124 of the basket 102. The first surface 306 of the splash shield has a plurality of tabs 308. There is a corresponding slot 126, 128 in the speaker basket for each tab 308 of the splash shield 300.

Each tab has a first portion 310 that extends a predetermined distance perpendicularly from the perimeter wall 302 into the opening 304. Each tab in the plurality of tabs 308 has a second portion 312 that extends a predetermined distance perpendicular to the first portion 310. Each tab 308 in the plurality of tabs 308 has a third portion 316 that extends a predetermined distance in a direction horizontal to the second direction and circumferentially with the opening 304. It should be noted that the splash shield 300 is molded in one piece and the first 310, second 312, and third 316 portions of the tab are continuous.

Figure 4:
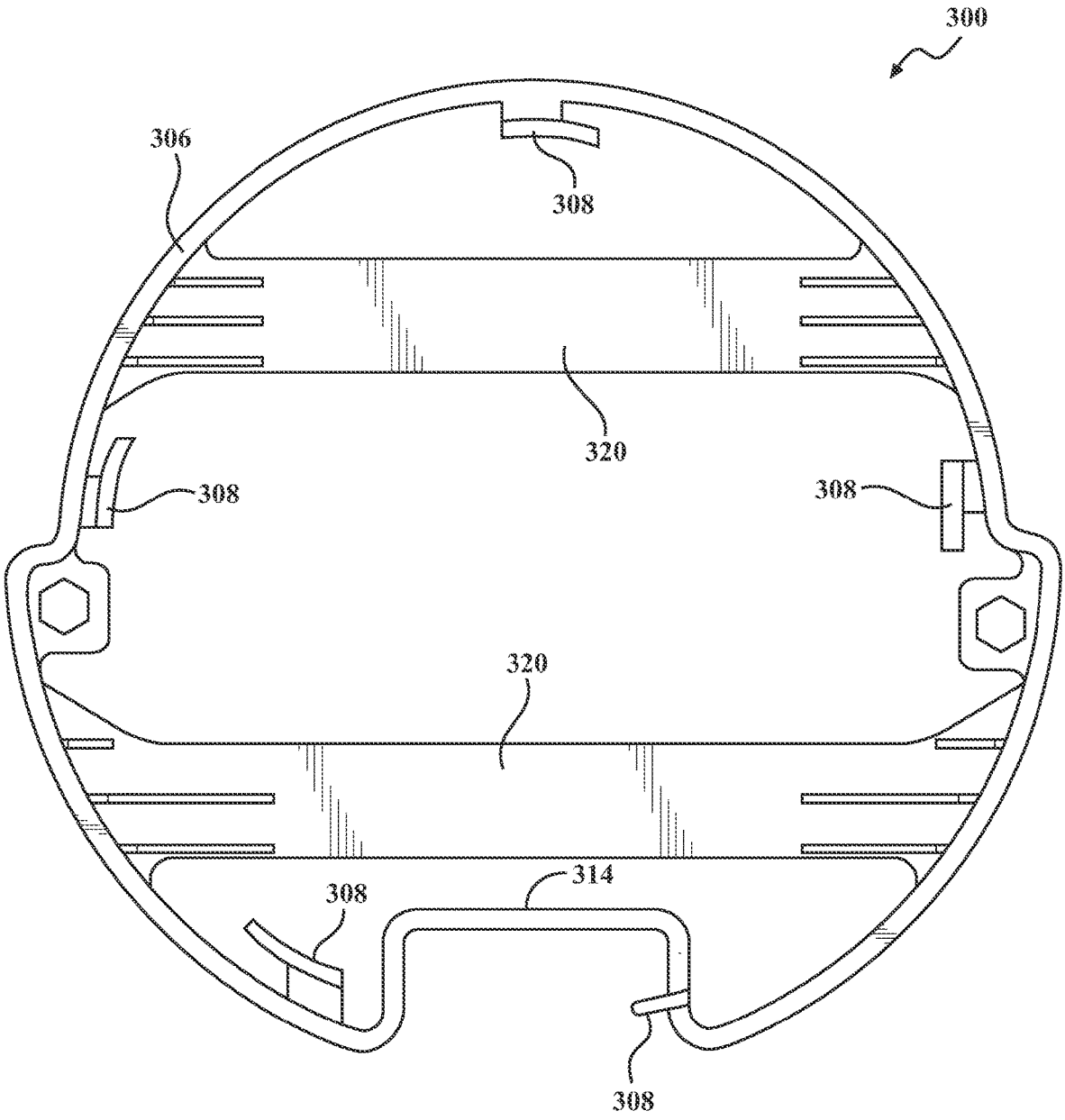
FIG. 4 is a front view of the splash shield.

FIG. 4 is a view of the first surface 306 of the splash shield 300. The tabs 308 are strategically positioned around the opening 304 in manner to provide adequate attachment points between the basket 102 and the splash shield 300. In the example shown in FIG. 4, the tabs 308 are spaced approximately equidistant from each other. However, the number, configuration, size, and arrangement of the tabs 308 depends upon the speaker assembly and its arrangement, or installation, in the vehicle.

One of the tabs 308 has a fourth portion 318 that extends a predetermined distance perpendicularly from the second portion 312 defining a locking tab 308. The locking tab aligns with the locking slot 128 in the basket 102. The locking slot 128 is the slot in the plurality of slots 126 that has the adjacent opening 130. When the splash shield 300 is assembled to the speaker basket 102 and the splash shield 300 is rotated, the fourth portion 318 of tab 308, cooperates with opening 130, locking the splash shield 300 in place in slot 128. The fourth portion 318 of locking tab 308 catches the opening 130 of the locking slot 128 and prevents the splash shield from rotating.

Figure 5:
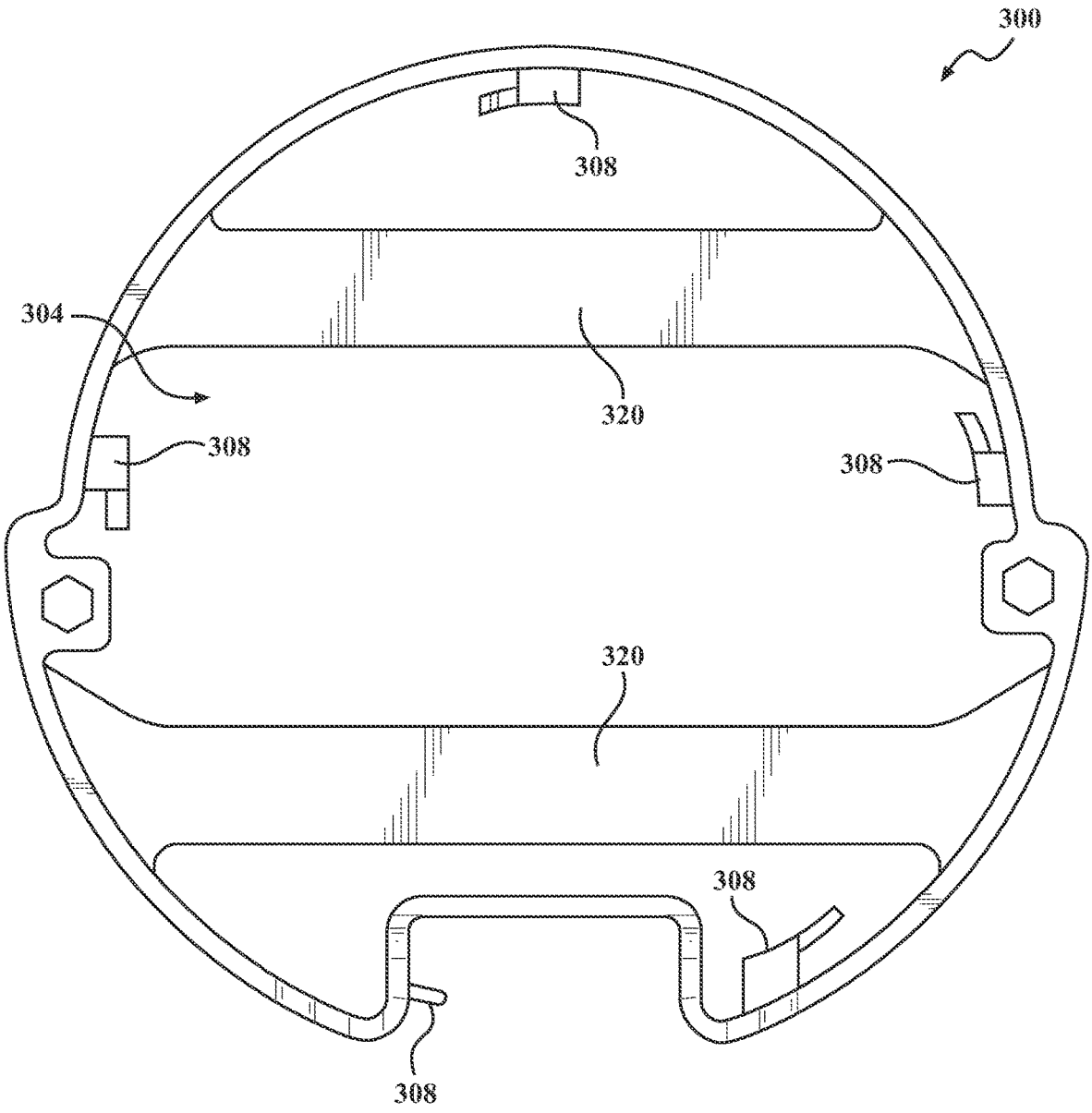
FIG. 5 is a rear view of a splash shield.

FIG. 5 is a rear view of the splash shield 300. One or more guards 320 extend contiguously across the opening 304 over a diameter of the opening 304. The guards 320 may vary in number, size, location, and configuration depending on the speaker assembly and its installation configuration in the vehicle. In the example shown in FIG. 4B, two guards 320 are shown. Each guard 320 has a predetermined width. The guards 320 serve the purpose of deflecting water away from the speaker assembly 100.

Referring again to FIG. 2, a rear view of the speaker assembly 100, shows the guards 320 and their arrangement with respect to the shell pot 118. One or more guards 320 extend contiguously across the opening 304 over a diameter of the opening 304. The guards 320 may vary in number, size, location, and configuration depending on the speaker assembly and its installation configuration in the vehicle. In the example shown in FIG. 2, the guards 320 have a predetermined width. The guards 320 serve the purpose of deflecting water away from the speaker assembly 100. The guards 320 also reinforce positioning of the shell pot 118 by providing supports that help to hold the shell pot in place. Typically, the shell pot 118 is held in place with adhesive or glue. An advantage of the splash shield 300 of the inventive subject matter is that the amount of glue can be reduced, or avoided all together, because the guards 320 assist in holding the shell pot 118 in place.

Figure 6:
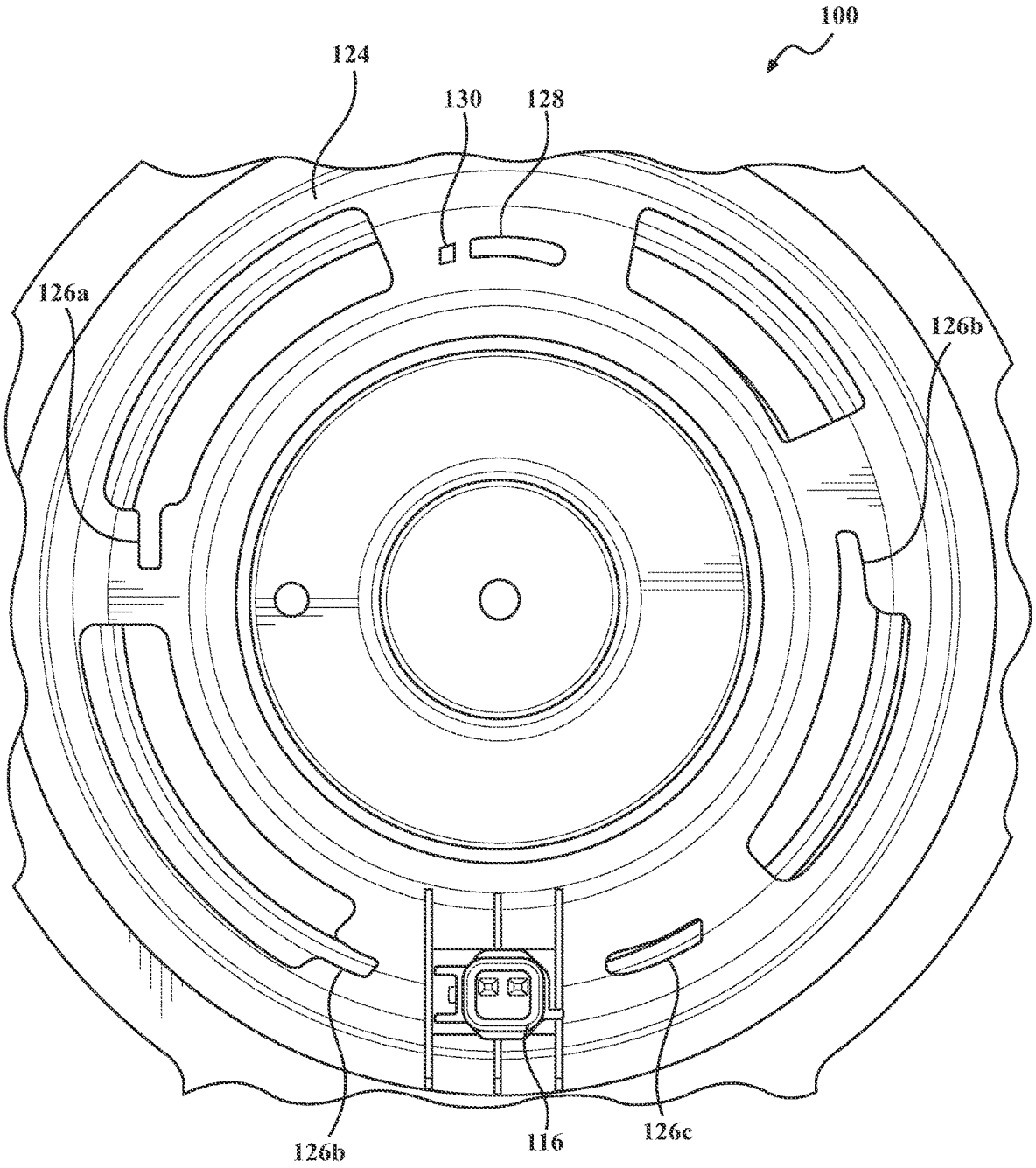
FIG. 6 is a close-up rear view of the speaker assembly without the splash shield assembled.

FIG. 6 is a close-up rear view of the speaker assembly 100 without the splash shield. The example shown in FIG. 6 has 5 slots 126*a*, 126*b*, 126*c*, 126*d* and locking slot 128 with opening 130. Referring again to FIG. 5, the number of tabs in the plurality of tabs 308 is equal to the number of slots 126 in the rear surface 124 of the speaker basket. The tabs in the plurality of tabs 308 are shaped such that they can be inserted into the plurality of annular slots. The splash shield 300 is attached to the basket 102 by aligning each of the tabs in the plurality of tabs 308 with each of the slots 126 in the plurality of slots 126 and inserting the tabs 308 into the slots 126. Twisting the splash shield in one direction secures the tabs 308 into the slots 128 by causing the third portion of the tab 308 to extend past the slot of the rear surface 124 of the speaker basket 102.

Figure 7:
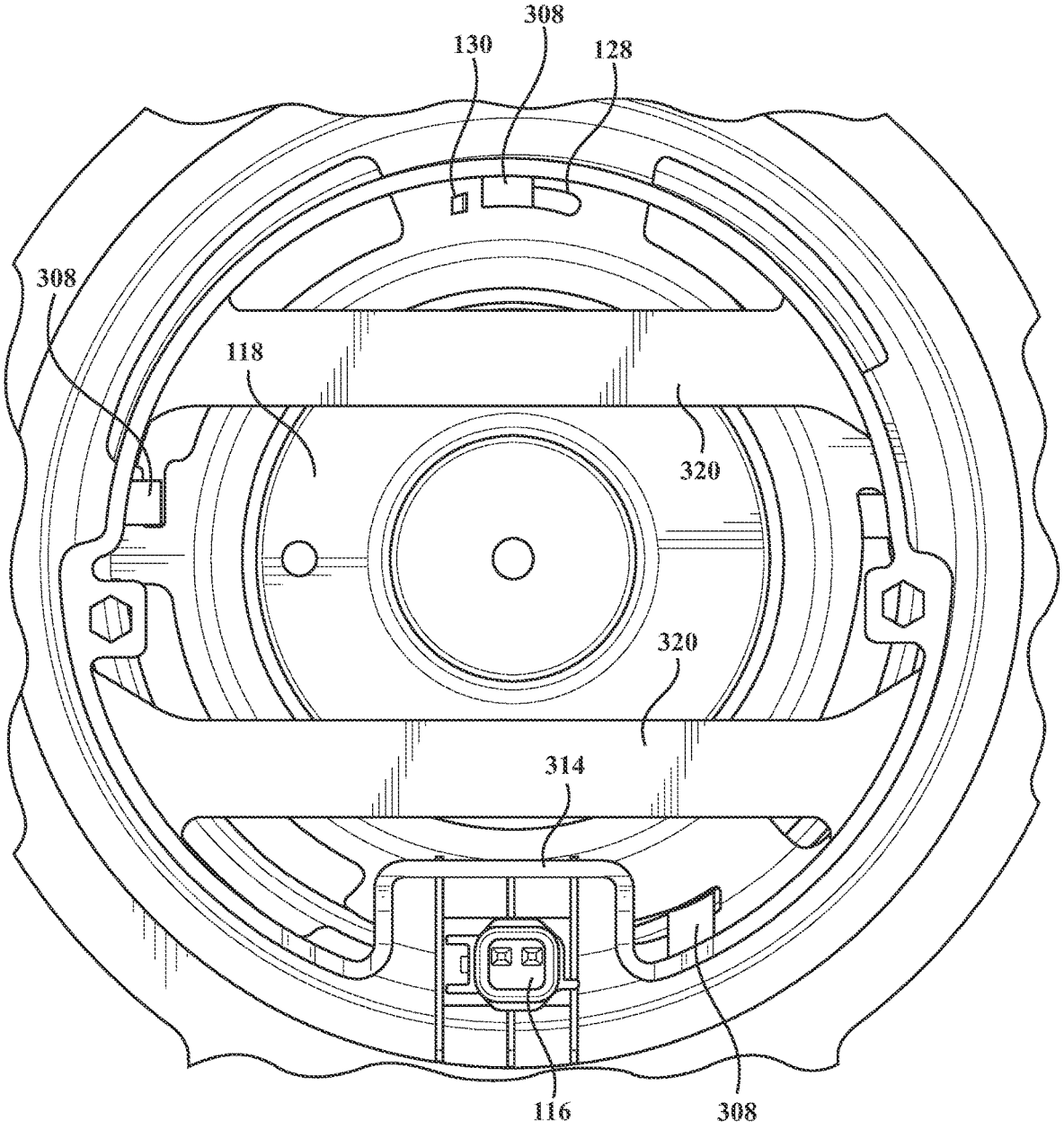
FIG. 7 is a close-up rear view of the speaker assembly.
Figure 8:
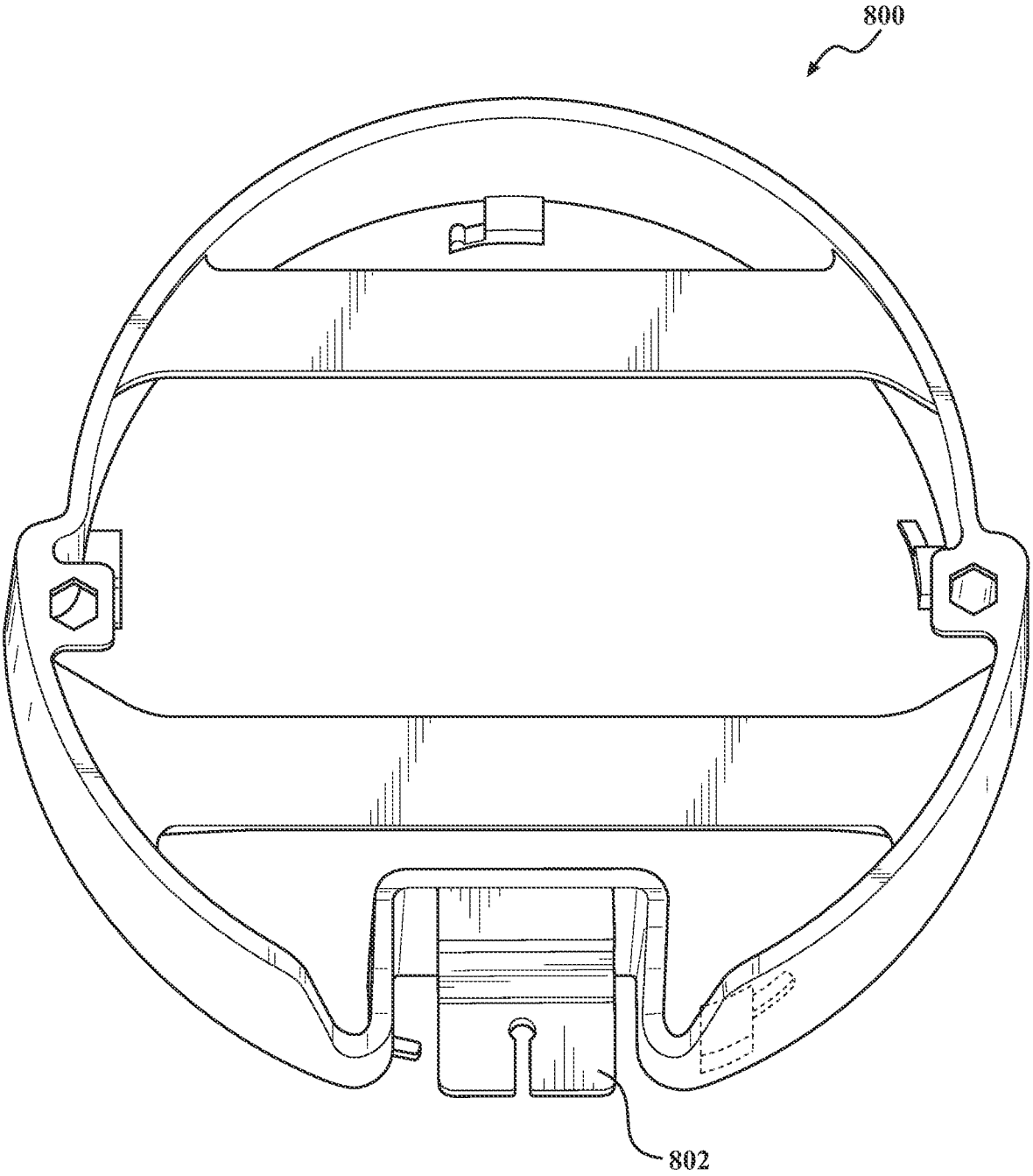
FIG. 8 is a perspective view of a splash shield of one or more embodiments.

The number of tabs in the plurality of tabs 308 is equal to the number of slots 126 in the rear surface 124 of the speaker basket. The tabs in the plurality of tabs 308 are shaped such that they can be inserted into the plurality of slots. The splash shield 300 is attached to the basket 102 by aligning each of the tabs in the plurality of tabs 308 with each of the slots 126, 128 in the plurality of slots 126, 128 and inserting the tabs 308 into the slots 128. Twisting the splash shield 300 in one direction secures the tabs 308 into the slots 128 and attaches the splash shield 300 to the basket 102. FIG. 7 is a close-up rear view of the speaker assembly 100 showing the splash shield 300 locked in place. The fourth portion 318 of tab 308 is locked into opening 130 adjacent to slot 128.

Referring again to FIG. 3, a height, h, of the perimeter wall 302 is shown. The height of the wall 302 is advantageous in that it allows the guards 320 to prevent water intrusion into the cone area of the speaker assembly 100, encloses the speaker without reducing SPL. The wall height, h, provides bigger openings at the speaker basket 102, creating a better sound performance for the speaker assembly 100.

The wall height, h, of the perimeter wall 302 also provides coverage for the connector area 116. The perimeter wall 302 has an indented segment 314 of its surface. This segment 314 is a portion of the perimeter wall 302 that is indented to accommodate a connector (not shown in FIG. 4) for the wire harness (also not shown). In one or more embodiments, shown in FIG. 8, the indented segment 314 of the splash shield 800 may be molded with a living hinge 802. The living hinge 802 has a surface area that is molded as part of the splash shield 800 and is operable to close over the wire harness connector (not shown), covering it and providing protection from contaminants, such as water, debris, etc.

The basket and splash shield are each molded as separate pieces that are assembled to each other before the speaker assembly is installed in a vehicle door. The basket is one piece molded from polycarbonate material. The splash shield 300, 800, also molded as one piece, is a polypropylene material. The combination of materials in the inventive subject matter, polycarbonate for the basket 102 and polypropylene for the splash shield 300, 800 introduces advantages. First, the inventive subject matter reduces cost because polypropylene is less expensive than polycarbonate. Another advantage realized is a reduction in rattle noises. Polypropylene is a softer, less rigid, material than polycarbonate. Therefore, the polypropylene splash shield 300, 800 reduces noises and rattles that commonly occur with more rigid polycarbonate structures. Further, the guards 320 of the splash shield help hold the shell pot 118 in place, which also reduces rattle noises. Separating the splash shield from the basket into a two-piece assembly allows the splash shield perimeter wall to be increased in height. The higher perimeter wall still prevents water intrusion, and it also increases the size of the openings in the speaker assembly 100 resulting in improved SPL.

In the foregoing specification, the present disclosure has been described with reference to specific exemplary embodiments. The specification and figures are illustrative, rather than restrictive, and modifications are intended to be included within the scope of the present disclosure. Accordingly, the scope of the present disclosure should be determined by the claims and their legal equivalents rather than by merely the examples described.

For example, the steps recited in any method or process claims may be executed in any order, may be executed repeatedly, and are not limited to the specific order presented in the claims. Additionally, the components and/or elements recited in any apparatus claims may be assembled or otherwise operationally configured in a variety of permutations and are accordingly not limited to the specific configuration recited in the claims. Any method or process described may be carried out by executing instructions with one or more devices, such as a processor or controller, memory (including non-transitory), sensors, network interfaces, antennas, switches, actuators to name just a few examples.

Benefits, other advantages, and solutions to problems have been described above with embodiments; however, any benefit, advantage, solution to problem or any element that may cause any particular benefit, advantage, or solution to occur or to become more pronounced are not to be construed as critical, required, or essential features or components of any or all the claims.

The terms "comprise", "comprises", "comprising", "having", "including", "includes" or any variation thereof, are intended to reference a non-exclusive inclusion, such that a process, method, article, composition, or apparatus that comprises a list of elements does not include only those elements recited but may also include other elements not expressly listed or inherent to such process, method, article, composition, or apparatus. Other combinations and/or modifications of the above-described structures, arrangements, applications, proportions, elements, materials, or components used in the practice of the present disclosure, in addition to those not specifically recited, may be varied, or otherwise particularly adapted, to specific environments, manufacturing specifications, design parameters or other operating requirements without departing from the general principles of the same.

What is claimed is:

1. A speaker assembly, comprising:

a speaker;

a speaker basket having an opening for receiving the speaker, the speaker basket has a rear surface with a plurality of slots positioned circumferentially about the opening on a perimeter of the rear surface; and a splash shield having an opening that coincides with the opening of the speaker basket and attaches to the rear surface of the speaker basket, the splash shield has a perimeter wall having a predetermined height, a plurality of tabs on a first surface of the perimeter wall align with and are inserted into the plurality of slots, and a plurality of guards extend across the opening of the splash shield, each guard in the plurality of guards has a predetermined width and space exists between guards in the plurality of guards.

2. The speaker assembly of claim 1, wherein the speaker basket is polycarbonate and the splash shield is polypropylene.

3. The speaker assembly of claim 1, wherein each tab in the plurality of tabs on the perimeter wall further comprises:

a first portion extending a predetermined distance perpendicularly from the perimeter wall;

a second portion extending a predetermined distance perpendicularly from the first portion; and a third portion extending horizontally from the second portion, upon twisting the splash shield relative to the speaker basket, the third portion extends beyond each corresponding slot in the plurality of slots.

4. The speaker assembly of claim 3, further comprising:

at least one tab has a fourth portion extending from the third portion perpendicularly to the second portion defining a locking tab;

one of the slots of the rear surface of the speaker basket has an opening adjacent thereto defining a locking slot; and the fourth portion of the locking tab is received by the opening of the locking slot lockimg the splash shield in place relative to the speaker basket.

5. The speaker assembly of claim 1, wherein the perimeter wall further comprises an indented segment to accommodate a connector for the speaker.

6. The speaker assembly of claim 5, wherein the indented segment further comprises a living hinge having a surface that extends over the indented segment covering the connector.

7. A speaker assembly, comprising:

a speaker;

a polycarbonate speaker basket having an opening for receiving the speaker, the speaker basket has a rear surface with a plurality of slots positioned circumferentially about the opening on a perimeter of the rear surface; and a polypropylene splash shield having an opening that coincides with the opening of the speaker basket and attaches to the rear surface of the speaker basket, the splash shield has a perimeter wall having a predetermined height, a plurality of tabs on a first surface of the perimeter wall align with and are inserted into the plurality of slots, and a plurality of guards extend across the opening of the splash shield, each guard in the plurality of guards has a predetermined width and space exists between guards in the plurality of guards.

8. The speaker assembly of claim 7, wherein each tab in the plurality of tabs on the perimeter wall further comprises:

a first portion extending a predetermined distance perpendicularly from the perimeter wall;

a second portion extending a predetermined distance perpendicularly from the first portion;

a third portion extending horizontally from the second portion, upon twisting the splash shield relative to the speaker basket, the third portion extends beyond each corresponding slot in the plurality of slots;

at least one tab has a fourth portion extending from the third portion perpendicularly to the second portion defining a locking tab;

one of the slots of the rear surface of the speaker basket has an opening adjacent thereto defining a locking slot; and the fourth portion of the locking tab is received by the opening of the locking slot locking the splash shield in place relative to the speaker basket.

9. The speaker assembly of claim 7, wherein the perimeter wall further comprises an indented segment to accommodate a connector for the speaker.

10. The speaker assembly of claim 9, wherein the indented segment further comprises a living hinge having a surface that extends over the indented segment covering the connector.

* * * * *